United States Patent [19]

Guice

[11] 4,253,371

[45] Mar. 3, 1981

[54] CARRIER/SADDLE STRUCTURE FOR STRINGED MUSICAL INSTRUMENTS

[76] Inventor: Ronald H. Guice, 3725 Broadmor Rd., Huntsville, Ala.

[21] Appl. No.: 73,922

[22] Filed: Sep. 10, 1979

[51] Int. Cl.[3] ..... G10D 3/04

[52] U.S. Cl. ..... 84/267; 84/297 R; 84/299; 84/307

[58] Field of Search ..... 84/267, 291, 297 R, 84/298, 299, 301, 307

[56] References Cited

U.S. PATENT DOCUMENTS

| | | | |
|---|---|---|---|
| 519,416 | 5/1894 | Turner | 84/299 |
| 1,010,240 | 11/1911 | Degulio | 84/307 |
| 2,025,875 | 12/1935 | Loar | 84/307 X |
| 2,196,531 | 4/1940 | Larisch | 84/299 X |
| 3,440,921 | 4/1969 | McCarty | 84/307 |
| 3,605,545 | 9/1971 | Rendell | 84/291 X |

FOREIGN PATENT DOCUMENTS

| | | | |
|---|---|---|---|
| 61182 | 2/1892 | German Democratic Rep. | 84/291 |

*Primary Examiner*—Lawrence R. Franklin
*Attorney, Agent, or Firm*—Gary L. Rigney

[57] ABSTRACT

An integrated carrier/saddle structure for securing strings to an acoustic guitar which eliminates structural loading that inhibits the motion of the sounding board and provides adjustable coupling of the string vibrations to the diaphram formed by the guitar sounding board. The carrier member, to which the strings are attached, is mounted independently of the sounding board and is incorporated into the saddle structure through an aperture with an adjustment means being provided to vary the height of the carrier with respect to the saddle to optimize the coupling force between the strings and sounding board. A removable cover, attached to the saddle, is provided to enclose the aperture formed around the extension of the carrier member through the saddle structure and the adjustment mechanism.

3 Claims, 6 Drawing Figures

CARRIER/SADDLE STRUCTURE FOR STRINGED MUSICAL INSTRUMENTS

BACKGROUND OF THE INVENTION

1. Field of the Invention

This invention relates to the construction of stringed musical instruments which employ a bridge in conjunction with a saddle, more particularly the specific structures associated with securing the strings over the sounding board diaphram and the coupling of the string vibrations thereto.

2. Description of Prior Art

In the conventional construction of an acoustical guitar, the strings are affixed to a carrier structure which is directly mounted upon the sounding board of the instrument with the strings rigidly positioned to make contact with a bridge element attached to a saddle which is, in turn, mounted to the sounding board. Vibrations induced in the strings are coupled into the sounding board via the bridge and saddle. In the present designs, the tensile loads, carried by the strings, are transmitted through the carrier to the sounding board which results in undesirable dampening of the diaphram action of the sounding board by virtue of the forces applied thereto and also as a consequence of the structural reinforcement necessary to prevent physical distortion of the sounding board by the applied tensile loading of the tuned strings.

One means for elimination of these dampening forces is, to some extent, described in U.S. Pat. No. 519,416 (issued May 8, 1894 to Robert L. Turner) for Tailpiece for Musical instruments wherein the carrier structure is affixed to the interior of the instrument and extends through two uncompensated apertures in the sounding board. The extremity of the described carrier, located at the exterior of the sounding board, supports and terminates the strings, while the bridge and saddle are of ordinary construction, with the exception that no provision is made for the usual termination and support of the strings in the saddle and that the protruding extremity of the carrier structure is separated from the bridge and saddle. The device as described by Turner possesses three distinct disadvantages, each of which are overcome by the present invention.

The first of these disadvantages relate to the method by which the adjustment of the coupling force between the strings and the sounding board is accomplished. In Turner, this adjustment is effected by the unaided human hand without any precision mechanism which would provide continuous positive adjustment with the mechanical advantage necessary to overcome the string loading of a tuned instrument. This constitues a serious deficiency in that this adjustment would require mechanically-aided precision in order to optimize the transfer of energy between the strings and the sounding board without the introduction of dampening forces resulting from the application of an excessive coupling force. Such excessive coupling forces are particularly detrimental in that they are applied at the source of vibration, i.e. where the strings come in contact with the bridge, and impede the freedom of motion of the sounding board. In contrast, a coupling force of insufficient magnitude results in an incomplete transfer of energy from the strings to the sounding board. The present invention incorporates the use of a device which provides a mechanical advantage with the precise positive adjustment necessary to optimize the coupling force applied to the bridge.

The second disadvantage associated with the device described in U.S. Pat. No. 519,416 relates to the extension of the carrier through the sounding board outside of the saddle structure. The aperture or orifices in the sounding board necessary for the carrier extension will, in themselves, serve as sources of undesirable distortions in the production of musical sound when they are displaced from the boundary of the saddle.

In the sounding board of an acoustical guitar of conventional construction, each note produces resonant nodes of vibration originating at a particular location on the sounding board that are uniquely determined by the frequency of the note. Evidence of this is shown in the reconstructed time-average holographic interferograms of the top plate of a typical guitar as provided in *The Journal of the Acoustical Society of America,* Volume 63, No. 5, page 1567; it is further illustrated by these holograms that the saddle contributes its own unique component in the formation of these nodes and will not, an any manner, serve to distort them or the sounded notes to which they are interrelated. Based upon such investigation, it is to be noted that a carrier, which supports the strings independently of the sounding board, would be contained within the saddle structure as provided by the present invention in order to preclude the formation of distortion sources.

A more simplified, but equally convincing, illustration of the foregoing is provided by considering the analogy between the sounding board of an acoustic guitar with its saddle as driving member and a loudspeaker diaphram with its own central circular driving member. Just as an orifice within the boundary of the central circular driving member of a loudspeaker will produce no distortions by virtue of its location within the source of vibrations, an analogous situation exists with an orifice contained within the boundary of an acoustic guitar's saddle which serves, in a like manner, as its source of vibrations. Similarly, a perforation in the exterior of the boundary of the central circular driving member of a loudspeaker will, in fact, produce sound distortions as will also occur in the case when an orifice exists in the exterior of the boundary formed by the saddle on the surface of the sounding board of an acoustical guitar. As stated earlier, this is overcome in the present invention by incorporating the carrier extension within the saddle structure.

A final disadvantage of the device described in U.S. Pat. No. 519,416 relates to the overall geometry of the described tailpiece with respect to the bridge and saddle structure. The additional proturberances and exposed apertures in the sounding board are undesirable and cumbersome from a functional standpoint and when compared to the proposed invention of this document, it is apparent that the described device is less than desirable if only from an aesthetic standpoint and with regard to the ease of playing the instrument. A comparison of the prior art as described in U.S. Pat. No. 519,416 with the present invention clearly illustrates that the present invention accomplishes independent string suspension, without introduction of distortion sources, by passing the carrier through the sounding board and incorporating it within the saddle structure; and offers a further advantage in the novel method by which precise adjustment of the coupling force between the tuned strings and bridge is achieved.

SUMMARY OF THE INVENTION

The present invention consists of an integrated carrier/saddle structure, for use in the construction of stringed musical instruments, which eleminates structural loading of the sounding board without providing an additional source of distortion. The present invention further provides a means for adjusting the mechanical coupling of the strings to the instrument sounding board to achieve an optimal transfer of vibrational energy. The entire structure is constructed so as not to interfere with the playing of the musical instrument. The specific objects of the present invention are set forth in the following paragraphs.

It is an object of the present invention to provide a means for the elimination of dampening forces applied to the sounding board of an acoustical guitar by virtue of string tensile loads being applied through the carrier structure to the sounding board without the introduction of acoustic distortion resulting from apertures in the sounding board.

It is a further object of the present invention to provide a practical means for adjusting the coupling force between the strings and sounding board of a tuned stringed musical instrument, such as an acoustic guitar, to effect maximum transfer of vibrational energy from the strings to the sounding board without the introduction of unnecessary and detrimental additional dampening forces which would impede the motion of the sounding board.

It is a further object of the present invention to incorporate the carrier and saddle structures into an integrated structure having an overall geometry which does not exhibit undesirable protruberances which would deter from the use of the instrument.

These and other objects, advantages, and characterizing features of the present invention will become more apparent upon consideration of the following detailed description thereof when taken in connection with the accompanying drawings.

BRIEF DESCRIPTION OF THE DRAWINGS

The novel features that are considered characteristic of this invention are set forth with particularity in the appended claims. The invention, itself, however, both as to its construction and implementation as well as additional objects and advantages thereof will best be understood from the following description when read in connection with the accompanying drawings, in which:

DESCRIPTION OF THE PREFERRED EMBODIMENT

Figure 1:
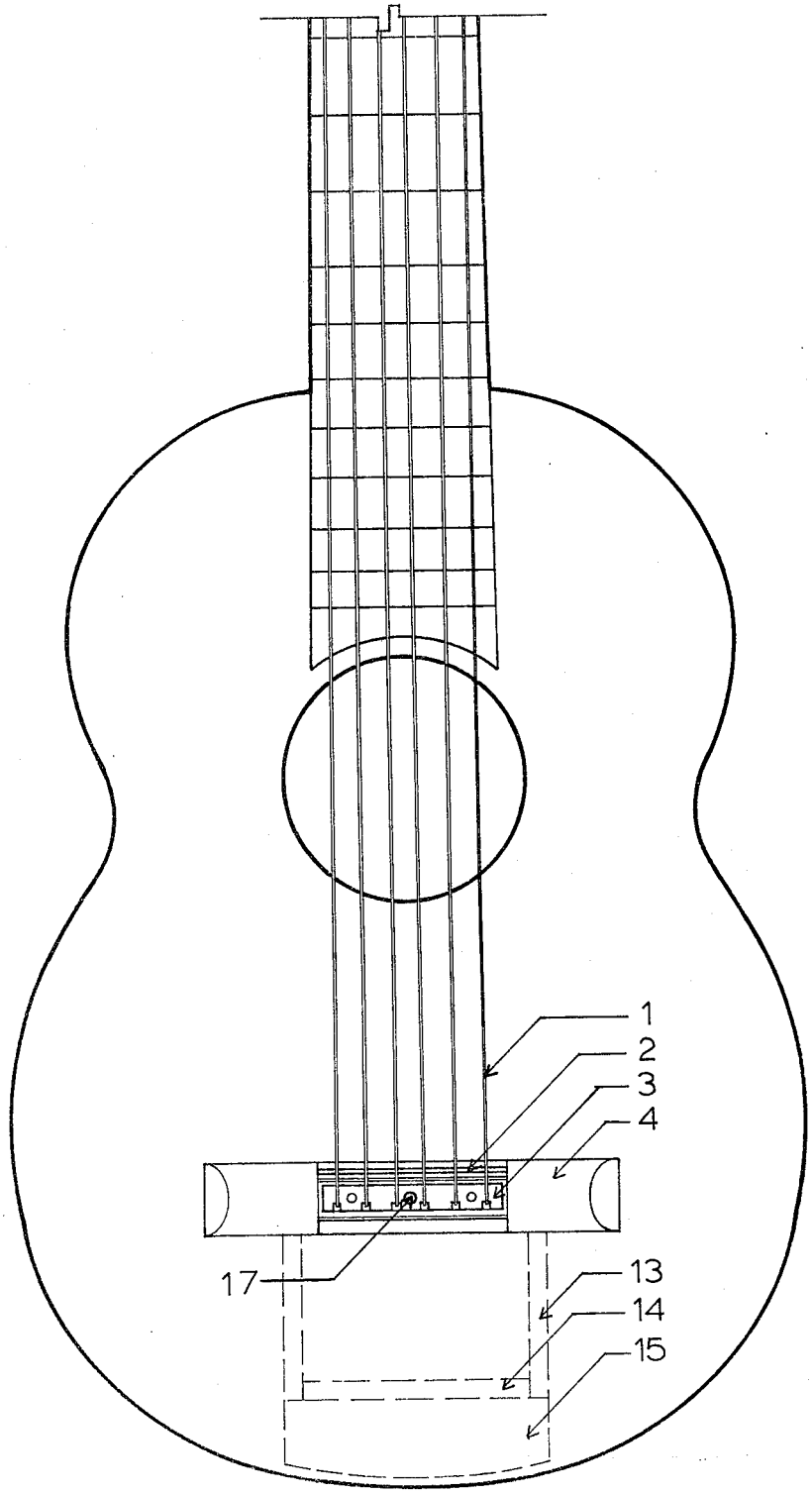
FIG. 1 is a top view of an acoustical guitar showing the implementation of an integrated carrier/saddle structure according to the present invention.
Figure 2:
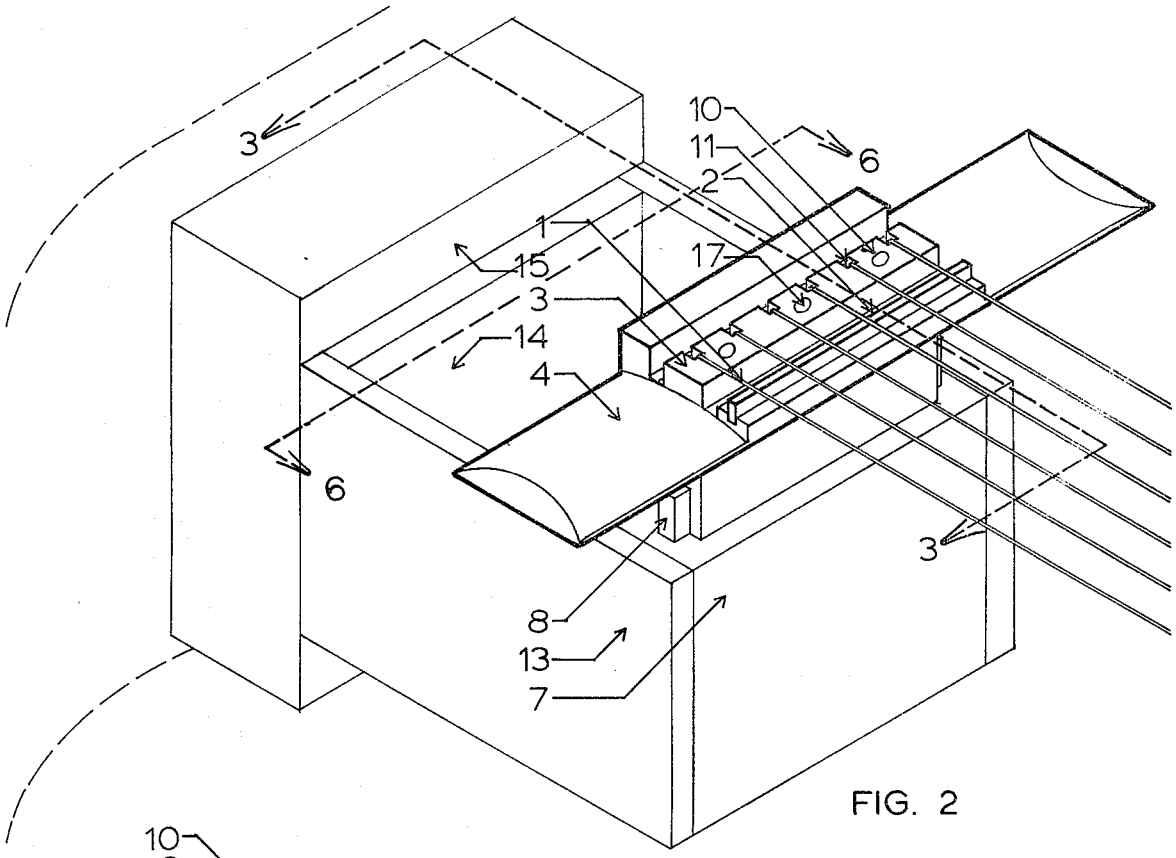
FIG. 2 is a fragmentary perspective view of the integrated carrier/saddle structure as shown in FIG. 1.
Figure 3:
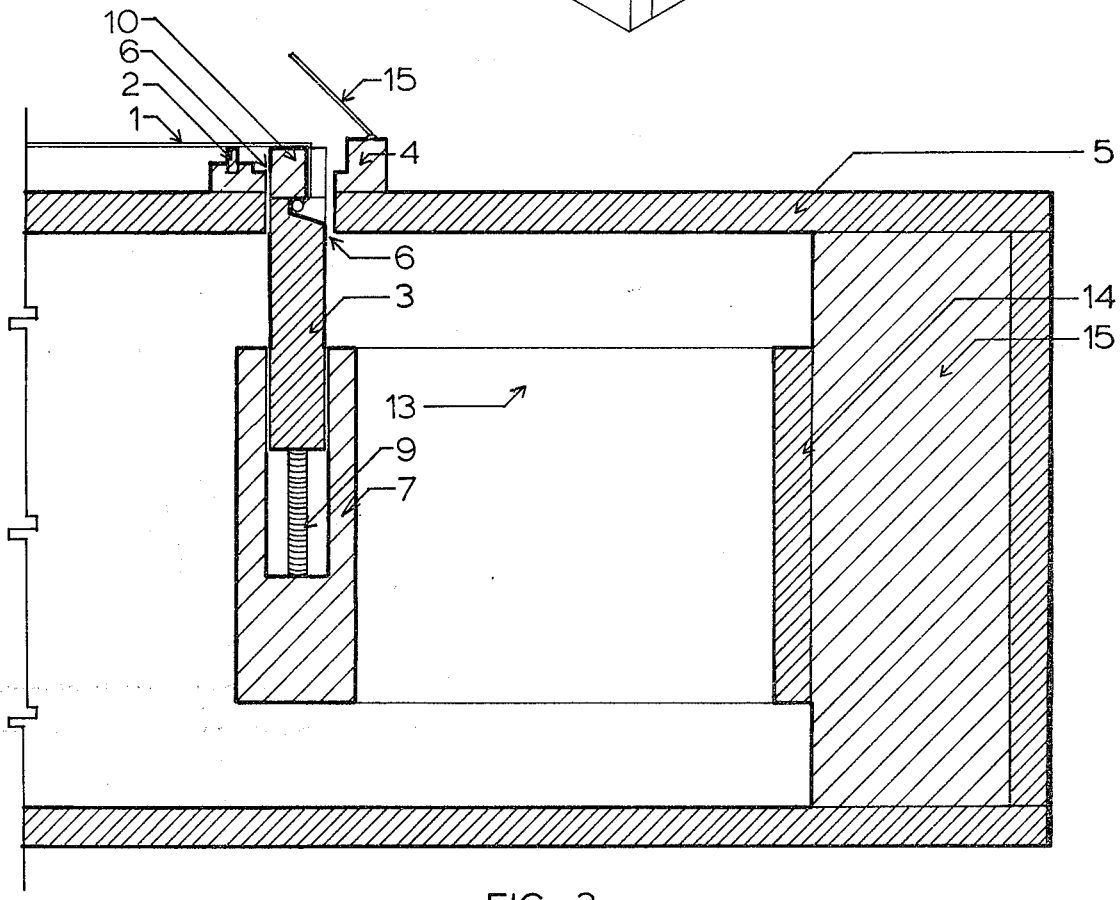
FIG. 3 is a transverse sectional view taken on line 3—3 of FIG. 2 and further shows a cover attachment in an open position.
Figure 4:
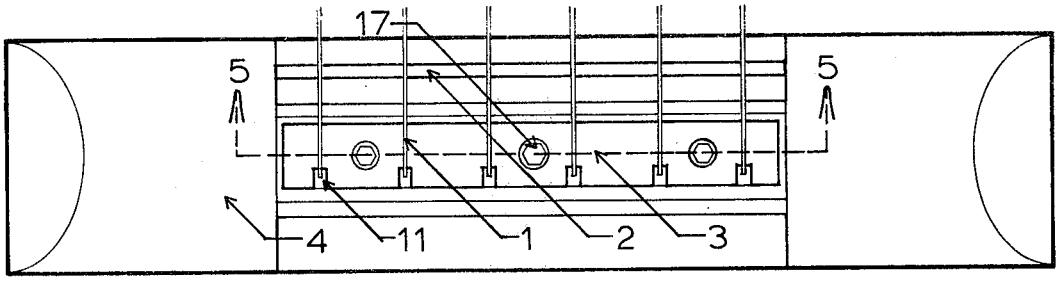
FIG. 4 is a top view of the exposed carrier/saddle structure shown in FIG. 1 showing the relative placement of the carrier extension within the saddle element.
Figure 5:
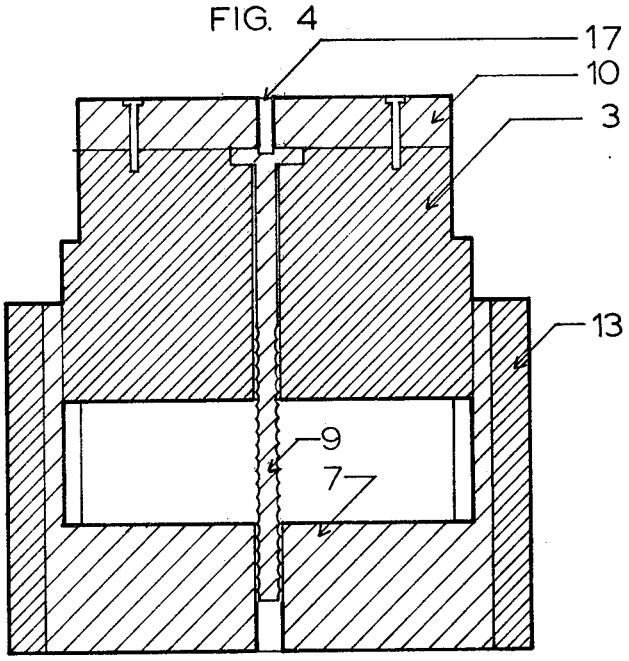
FIG. 5 is a sectional view illustrating the implementation of an adjustment means within the carrier element shown in FIG. 4 along the section line 5—5.

The integrated carrier/saddle structure of this invention may be perhaps best understood by referring first to FIGS. 1 and 3. These figures depict the construction of the saddle member 4 which is attached to the sounding board 5 of a stringed musical instrument and supports a bridge structure 2 which, in turn, is in contact with the instrument strings 1. The instrument strings 1 are secured and held rigid under their associated tensile loads by an attachment fixture 10 which is affixed to a carrier member 3. The carrier member 3 is adjustably mounted in a guide frame 7 and extends through an aperture 6 located in the sounding board 5 into the saddle member 4. The tensile loads of the tuned strings 1 are transmitted to the instrument rear block 15 through the carrier side blocks 13 and carrier rear block 14 which are rigidly attached to each other and the guide frame 7 and instrument rear block 15, respectively.

One novel aspect of the present invention resides in the unique construction of the saddle member 4 which encloses an aperture 6 in the sounding board 5 from which the carrier member 3 extends. The saddle member 4 serves as a transducer to couple vibrations which are induced into the bridge 2 by the strings 1, into the sounding board 5. By constructing the saddle member 4 from a stiff material, such as rosewood, and completely enclosing the aperture 6 contained in the sounding board 5 to permit the extension of the carrier member 3 from the instrument interior, phase distortion introduced by the discontinuity formed by the aperture 6 is minimized. The advantages of this configuration are twofold; the aperture 6 serves to reduce the sprung mass associated with the transducer system composed of the bridge 2 and saddle 4, and the selected saddle geometry serves to reinforce the aperture 6 which would otherwise serve as a source for distortion.

Figure 6:
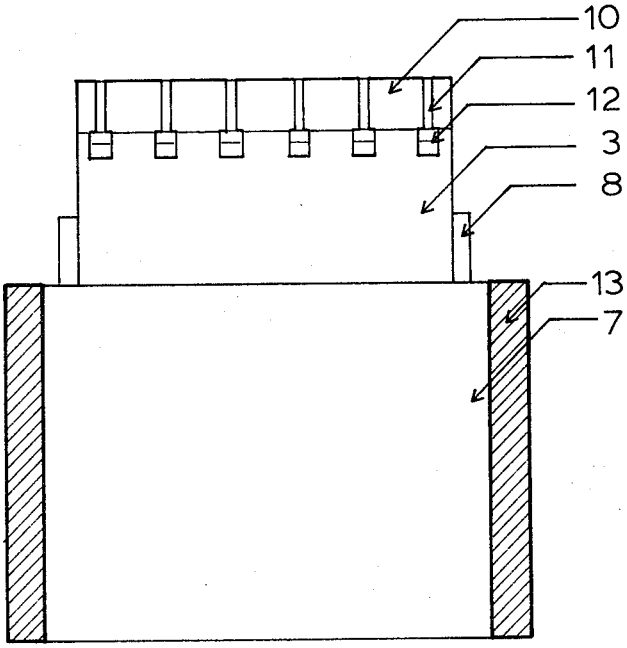
FIG. 6 is a sectional view of the carrier element shown in FIG. 2 taken along the section line 6—6 illustrating a method for attachment of the strings.

In the case of a conventional acoustic guitar, the sole construction modification necessary to implement the present invention consists of the aperture 6 in the sounding board 5 to permit the extension of the carrier 3 and attachment fixture 10. As stated earlier, this modification is compensated by the unique construction of the saddle 4. The carrier 3 is constructed from a rigid structural material, such as aluminum, and is engaged within the guide frame 7 by index ribs 8 which are formed by the carrier 3 structure and engage complimentary slots within the guide frame 7 to permit the translation of the carrier 3 within the guide frame 7 in order to vary the coupling force between the strings 1 and the bridge 2. Adjustment of the coupling force between the strings 1 and the bridge 2 may be accomplished by varying the height of the carrier 3 with the adjustment bolt 9 by an appropriate driver tool inserted in the adjustment port 17 located in the attachment fixture 10. The attachment fixture 10 is constructed from a rigid structural material and is rigidly attached to the upper surface of the carrier 3. The attachment fixture 10 is slotted to permit the passage of the strings 1 into a notch formed by the upper surface of the carrier 3 at the junction with the attachment fixture 10, as shown in FIGS. 3 and 6, where the strings are engaged and held secure by stops which are placed conventionally at the string termination. The attachment fixture serves two purposes; first, to provide a guide and holding surface for the strings 1 and, second, to capture the adjustment bolt 9 within the carrier 7 structure. A cover structure 15, fabricated from rosewood, is hinged to the rear surface of the bridge 2 with a strip composed of plastic, or other suitable material having a shape memory, such that it may be raised to provide access to the adjustment port 17 as shown in FIG. 3.

I claim:

1. An improved carrier/saddle structure for coupling strings to the sound box of a stringed musical instrument which comprises;

(a) a conventional sounding board structure, forming a surface of the sound box, which is modified to include an aperture;

(b) a saddle attached to the said sounding board having an aperture aligned with and complimentary to the aperture of said sounding board;

(c) a carrier structure secured to the interior of the sound box independent of the said sounding board having an attachment member, which extends through the aperture contained in the said sounding board and said saddle, to which the strings are attached;

(d) A bridge affixed to the said saddle in contact with the strings.

2. The improved carrier/saddle structure as described in claim 1 wherein the said carrier structure incorporates an adjustment means to continuously vary the extension of said attachment member.

3. The improved carrier/saddle structure as described in claim 1 which further comprises a cover member which is attached to the said saddle and extends over the said attachment member.

* * * * *